US007395883B2

(12) United States Patent
Beccu

(10) Patent No.: US 7,395,883 B2
(45) Date of Patent: Jul. 8, 2008

(54) KEYED CONNECTION FOR DRILL BIT

(75) Inventor: Rainer S. Beccu, Houston, TX (US)

(73) Assignee: Rockmore International, Inc., Wilsonville, OR (US)

( * ) Notice: Subject to any disclaimer, the term of this patent is extended or adjusted under 35 U.S.C. 154(b) by 161 days.

(21) Appl. No.: 11/303,223

(22) Filed: Dec. 15, 2005

(65) Prior Publication Data

US 2007/0137899 A1 Jun. 21, 2007

(51) Int. Cl.
*E21B 10/36* (2006.01)
*E21B 4/14* (2006.01)

(52) U.S. Cl. ..... 175/415; 175/296; 173/108; 173/90; 173/104

(58) Field of Classification Search ..... 175/415, 175/296, 625.6, 320, 321; 166/242.6, 242.7; 285/91; 403/293, 294, 298; 173/108, 90, 173/104

See application file for complete search history.

(56) References Cited

U.S. PATENT DOCUMENTS

| | | | | | |
|---|---|---|---|---|---|
| 1,670,896 | A | | 5/1928 | Maickel et al. | |
| 2,145,466 | A | * | 1/1939 | Urschel | 175/415 |
| 2,371,498 | A | * | 3/1945 | Martin | 175/322 |
| 2,524,707 | A | * | 10/1950 | Koeln | 175/299 |
| 3,241,624 | A | | 3/1966 | Rassieur | |
| 3,613,807 | A | * | 10/1971 | Galis | 175/209 |
| 4,368,789 | A | * | 1/1983 | Orr et al. | 175/418 |
| 4,615,402 | A | * | 10/1986 | Eisenloeffel | 175/320 |
| 4,706,764 | A | | 11/1987 | Hughes | |
| 4,819,748 | A | * | 4/1989 | Truscott | 175/420.1 |
| 4,840,235 | A | * | 6/1989 | Masse | 173/104 |
| 5,150,636 | A | | 9/1992 | Hill | |
| 5,332,049 | A | * | 7/1994 | Tew | 175/320 |
| 5,435,401 | A | | 7/1995 | Hedlund et al. | |
| 5,788,430 | A | * | 8/1998 | Meyen et al. | 408/226 |
| 6,938,710 | B2 | * | 9/2005 | Simmons | 175/57 |
| 2002/0020566 | A1 | * | 2/2002 | Hauptmann et al. | 175/415 |
| 2004/0238223 | A1 | * | 12/2004 | Brady | 175/320 |
| 2006/0278433 | A1 | * | 12/2006 | Walker et al. | 175/57 |

FOREIGN PATENT DOCUMENTS

| | | |
|---|---|---|
| CA | 2125882 | 8/1993 |
| GB | 1 242 052 | 8/1971 |

OTHER PUBLICATIONS

International Search Report and Written Opinion of the International Searching Authority for PCT/US06/44342, ISA/US, 7 pages, mailed Jul. 25, 2007.

* cited by examiner

*Primary Examiner*—Jennifer H Gay
*Assistant Examiner*—Cathleen R Hutchins
(74) *Attorney, Agent, or Firm*—Klarquist Sparkman, LLP

(57) ABSTRACT

A portion of a drilling tool having a drill bit driven in a rotating motion and in an axial percussion motion comprises a keyed connection between the drill bit and a driver sub that receives the drill bit. The keyed connection comprises a transverse member coupling the drill bit to a driver sub having a bore within which the drill bit is received. The driver sub has a pair of opposed openings and the bit has an axial slot. The openings and the slot are dimensioned to receive the transverse member. The keyed connection transmits force to the drill bit to drive the drill bit during operation and removably secures it in the driver sub.

23 Claims, 9 Drawing Sheets

KEYED CONNECTION FOR DRILL BIT

FIELD

This application relates to drilling equipment, and in particular, to heavy duty drilling tools, such as rock drilling tools.

BACKGROUND

In heavy duty drilling tools, such as rock drilling tools, the drill bit has a working end shaped to bore holes and/or remove material and an opposite proximal end connected to the remaining portion of the drilling tool. The proximal end of the drill bit is driven by a source of power such that the drill bit typically has a rotary motion, an axial percussive motion and/or some combination of these motions.

The proximal end of the drill bit is secured to the drilling tool for operation and is removable to allow use of a different drill bit or to service the current drill bit or the drilling tool. In drilling tools with bits capable of rotary and axial motion, there are multiple connections between the drill bit and the remaining portion of the drilling tool to allow torque and force to be transmitted to the drill bit.

In rock drilling applications, many of the drilling tools are operated by a pressurized fluid source and have an axial bore and openings in the drill bit through which fluid is conveyed. The axial bore and openings can convey a flushing medium out through the distal end of the drill bit. Alternatively, in a reverse circulation drilling tool, fluid and material can be drawn in through the openings and conveyed toward the proximal end of the drilling tool.

According to another conventional approach, although not widely used, a drill bit having a three-sided (i.e., non-circular) cross-section is secured in a surrounding chuck by a key extending transverse to the drill bit's axis, but the key does not extend through the center of the bit, and the bit must be provided with a flat section against which the key can engage. It is the three-sided shape of the chuck and bit, and not the key, through which torque is transmitted. The key fixes the drill bit's axial position relative to the chuck. In addition, the drill bit has a solid cross-section, and there is no provision for using the off-center transverse key in a drill bit having an axial bore.

According to another conventional approach, which is in wider use, the proximal end of the drill bit is received in a bore defined in a surrounding component, referred to as a driver sub. The bore and the drill bit have a first splined connection allowing torque to be transmitted to the drill bit. To secure the drill bit to the drilling, there is a second connection, such as by way of retaining rings, between a different portion of the drill bit and a surrounding component, such as a wear sleeve. The second connection allows axial force to be transmitted to the drill bit.

This conventional approach has several drawbacks. First, the splined connection is subject to excessive wear and early failure in some environments. The splined connection is also difficult to manufacture, making the drilling tool and drill bit more expensive. In addition, requiring two separate connections consumes additional space within the drilling tool and requires the drilling tool to have added length, which is a disadvantage. Moreover, the retaining rings used for the second connection can become difficult to remove after use.

SUMMARY

Described below are embodiments of a keyed connection for a drill bit that address some of the deficiencies in prior art drilling tools.

According to one implementation, a portion of a drilling tool having a drill bit driven in a rotating motion and in an axial percussion motion comprises a keyed connection between the drill bit and a driver sub. The driver sub has a bore within which the drill bit can be received. The keyed connection comprises a transverse member and a transverse opening in the drill bit and opposed openings in the driver sub dimensioned to receive the transverse member. When assembled, the keyed connection couples the drill bit to the driver sub during rotation and percussion and is capable of transmitting torque from the driver sub to the drill bit to drive the drill bit in rotation.

The transverse opening in the drill bit can have an axial extent greater than a corresponding dimension of the transverse member, thus allowing the bit to move axially within a selected ranged while coupled to the driver sub.

The transverse member can be accessible from an outer surface of the driver sub. Alternatively, the ends of the transverse member may be partially or fully covered by a wear sleeve or other component at least partially surrounding the driver sub.

The driver sub can be connected to a distal end of a wear sleeve. The driver sub can be connected to the wear sleeve by a threaded connection.

The bit may comprise an axial bore for conveying a stream that comprises at least fluid. The transverse opening may be an axial slot that intersects the axial bore. The transverse member may comprise an intermediate portion of reduced cross-section to minimize disruption of the stream through the bore.

The transverse member can have a first axial end and a second axial end opposite the first axial end, with the first axial end having a shorter dimension than the second axial end.

According to another implementation, a portion of a drilling tool having a drill bit with an inner bore and inner passages communicating with the inner bore for conveying a stream comprising at least a fluid during drilling operations comprises a component and a key. The component has a bore sized to receive the drill bit and a transverse opening extending through at least one side of the bore. The key is shaped to be inserted through the transverse opening within the bore and to extend through an opening in the drill bit and at least partially into the inner bore of the drill bit to secure the drill bit to the component. A portion of the key that is positioned within the inner bore, when the key is assembled together with the drill bit and the component, has a reduced size to minimize disruption of the stream through the bore.

The opening in the drill bit can be a slot having an axial length greater than a corresponding dimension of the key, thus allowing the bit to move axially with a selected range while secured to the component.

The component can be a driver sub. Alternatively, the component can be a wear sleeve. The component can be configured for attachment to a distal end of a wear sleeve.

The component can comprise a distal end having an outer diameter and a proximal intermediate portion separated from the distal end by a shoulder. The intermediate portion can have a reduced diameter less than the outer diameter, the transverse opening having a proximal portion extending through the intermediate portion and a distal portion extending through the distal end. The key can have a proximal edge with notched corners such that side edges of the key are alignable with outer surfaces of the intermediate portion and of the distal end.

The portion of the drilling tool can comprise a wear sleeve adapted to connect to the component and to abut against the shoulder such that the wear sleeve covers at least a portion of the side edges of the key when connected to the component.

According to another implementation, a drill bit connection for connecting a drill bit to a drilling tool comprises an opening defined in the drill bit and extending transverse to an axis of the axis of the drill bit and a generally elongate key shaped to be inserted through the opening of the drill bit. The opening has a first axial dimension and a second dimension in the circumferential direction generally perpendicular to the axial direction. The key has opposite ends shaped to be fixed to surrounding structure for holding the drill bit. The key has a key axial dimension less than the first axial dimension of the opening and a key circumferential dimension sized to closely fit the second dimension of the opening. The fit between the opening in the drill bit and the key allows the drill bit to be axially reciprocated relative to the key and the surrounding structure, and allows the key to transmit torque for smoothly rotating the drill bit.

The drill bit can have an axial bore, and the opening can intersect the axial bore. The opening can be a slot extending through the drill bit. The key can have an intermediate portion between its opposite ends, with the intermediate portion having a reduced cross-section smaller than a cross-section of either of the opposite ends.

The surrounding structure can be a chuck that receives the drill bit and the ends of the key can be shaped to be fixed to the chuck. The surrounding structure can also be a driver sub or a wear sleeve.

DETAILED DESCRIPTION

Described herein is a keyed connection between a drill bit and a component that receives the drill bit, e.g., a driver sub, chuck or other component. The keyed connection comprises a transverse member and a transverse opening in the drill bit such that the key couples the drill bit to the component and allows at least rotational motion (i.e., torque) to be applied to the drill bit to drive the drill bit in rotation.

Figure 1:
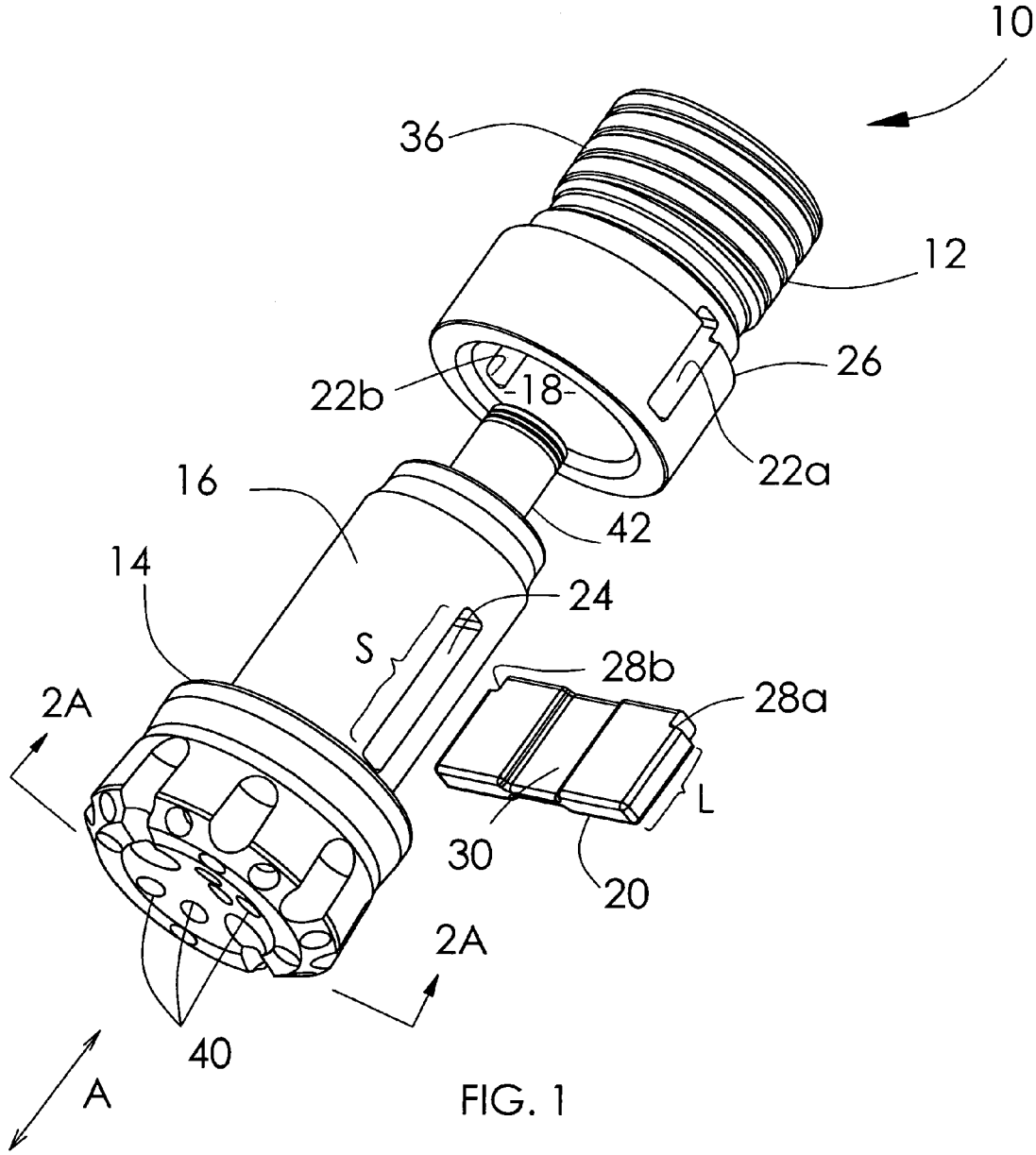
FIG. 1 is an exploded perspective view of a portion of a drilling tool showing, at a proximal end of the portion, a driver sub with a bore, a bit having a shaft dimensioned to be received in the bore and a transverse key shaped to removably secure the top sub and shaft of the bit together.

FIG. 1 is a perspective view of a portion of a drilling tool 10 having a new keyed bit retainer. The portion of the drilling tool 10 shown in FIG. 1 has a keyed sub 12 at a proximal end and bit 14 with a shaft 16 at a distal end that is received in an axial bore 18 defined in the keyed sub 12. A key 20 can be inserted through an opening 22*a* in the keyed sub 12, through an axial slot 24 in the shaft 16 and into an opening 22*b* opposite the opening 22*a* to removably secure the bit 14 to the keyed sub 12.

Figure 2A:
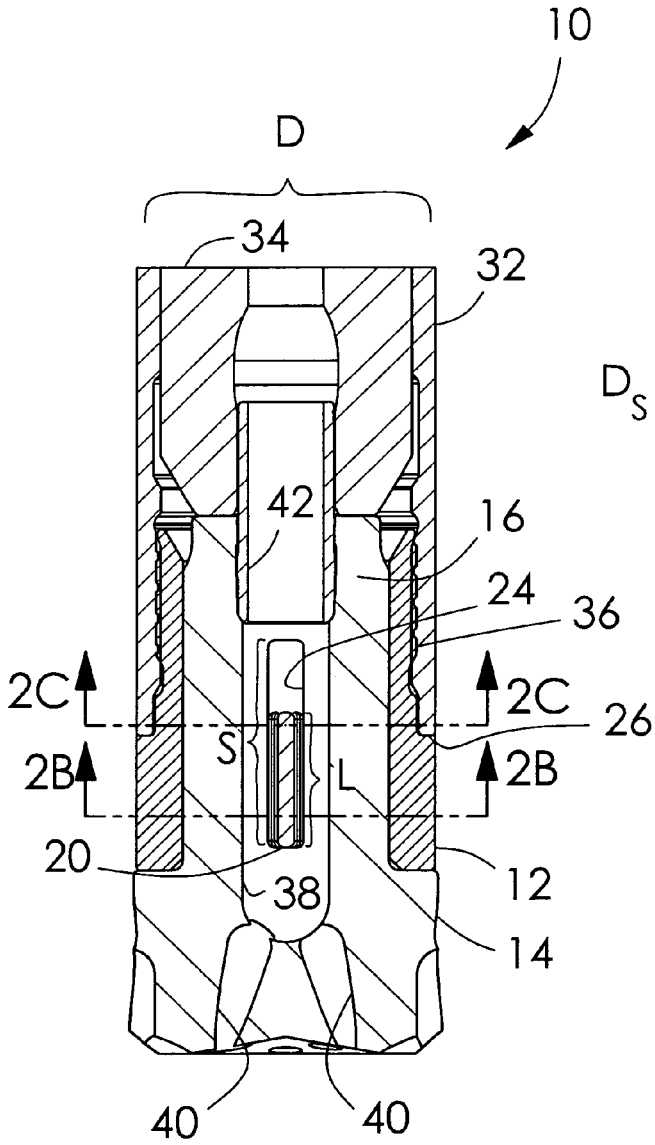
FIG. 2A is a sectioned view in elevation of the portion of a drilling tool, when assembled, taken at the line 2A-2A in FIG. 1, and also showing a cylinder and a surrounding wear sleeve.
Figure 2C:
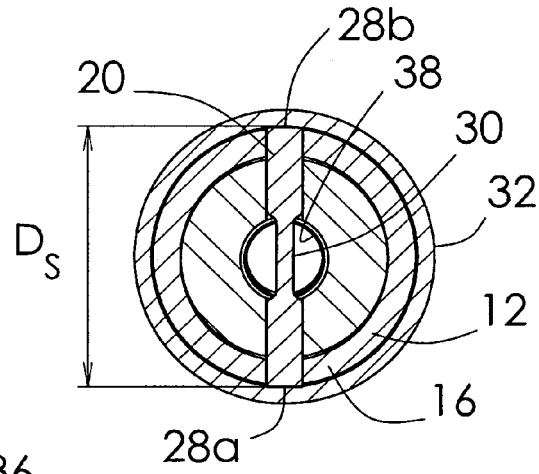
FIG. 2C is a cross-sectional plan view taken at the line 2C-2C in FIG. 2A.
Figure 2B:
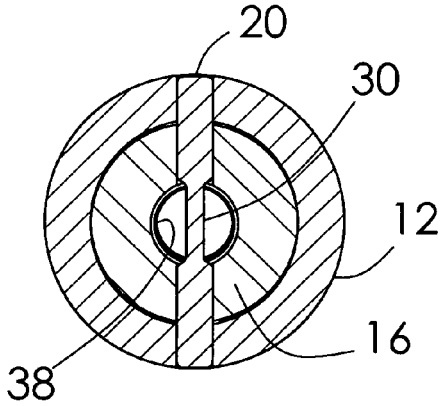
FIG. 2B is a cross-sectional plan view taken at the line 2B-2B in FIG. 2A.
Figure 2D:
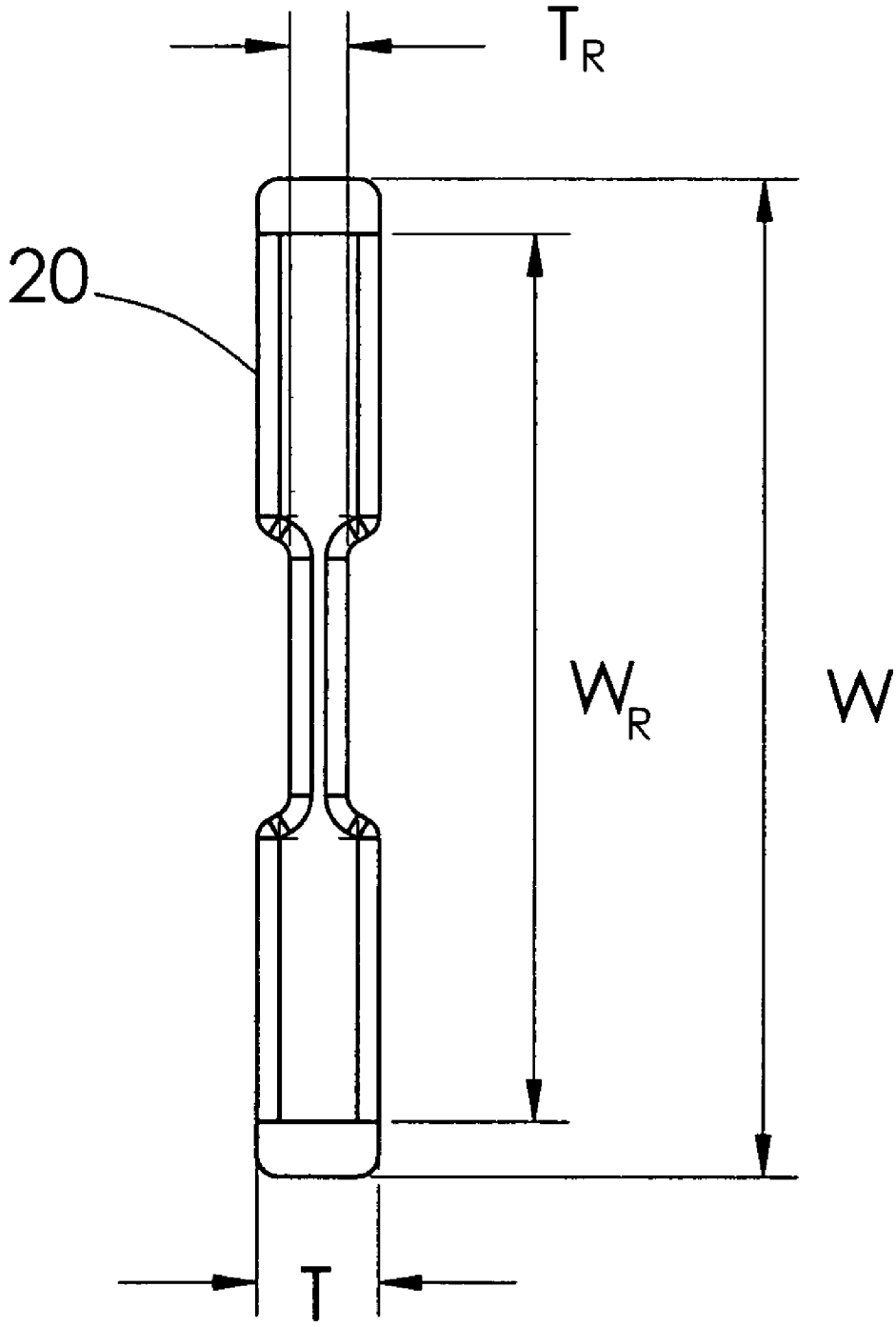
FIG. 2D is a plan view of the transverse key of FIG. 1.

As shown in FIGS. 1 and 2D, the key 20 is a generally rectangular solid having a width W, a length L and a thickness T. As shown, the key 20 can have a reduced thickness $T_R$ in an intermediate region 30 spaced from its ends.

As shown in FIG. 1, the slot 24 in the shaft is dimensioned to have a length S greater than the length L of the key, which allows the bit 14 to move axially relative to the keyed connection (i.e., the keyed sub 12 and key 20) when the drilling tool 10 is in use. The slot 24 has a narrow dimension sized according to the thickness T to slidingly receive the key 20.

The shaft 16 is slidably received in the bore 18, and the surfaces of the shaft 16 and bore 18 form guiding surfaces that maintain the bit 14 in proper orientation during use.

In the FIG. 1 embodiment, the keyed sub 12 has an outer diameter approximately equal to the outer diameter D (FIG. 2A) of the drilling tool. The width W of the key 20 is dimensioned approximately equal to the outer diameter D, and portions of the key 20 are visible through the openings 22*a*, 22*b* in the assembled drilling tool 10 (FIG. 2B).

The keyed sub 12 has a shoulder 26 defining a reduced outer diameter $D_S$ that intersects the openings 22*a*, 22*b*. The key 20 has corresponding notches 28*a*, 28*b* at its proximal end resulting in a reduced width $W_R$ dimensioned to fit within the outer diameter $D_S$.

FIG. 2A is a sectioned view in elevation of the keyed sub 12, bit 14 and key 20 of FIG. 1 assembled together, and also showing a portion of a proximally extending outer sleeve 32 connected to an outer surface of the keyed sub 12 and abutting the shoulder 26 and a proximally extending portion of an axially reciprocable piston 34 slidably received in the sleeve 32. The keyed sub 12 has exterior threads 36 by which it is connected to the outer sleeve 32.

As shown in FIG. 2A, the bit 14 has internal flow passages, including an axial passage 38 leading to at least one terminal passage 40 opening at the distal end of the bit 14. The axial passage 38 is extended by a blow tube 42 (also referred to as a foot valve) that projects from the proximal end of the shaft 16 (FIG. 1) and fits within a passage in the piston 34.

The cross-sectional view of FIG. 2B shows a distal portion of the key 20 extending its full width W approximately equal to the outer diameter D and connecting the outer keyed sub 12 and the inner bit 14 together. The cross sectional view of FIG. 2C shows a proximal portion of the key 20 extending its reduced width $W_R$ equal to the diameter $D_S$ and showing the outer sleeve 32 fitting adjacent the notches 28*a*, 28*b* and around the keyed sub 12.

As also shown in FIGS. 2B and 2C, the intermediate portion 30 of the key with its reduced thickness $T_R$ poses less restriction to fluid flow through the axial passage 38, yet is sufficiently strong to resist deformation of the key 20 during use of the tool 10.

Figure 3A:
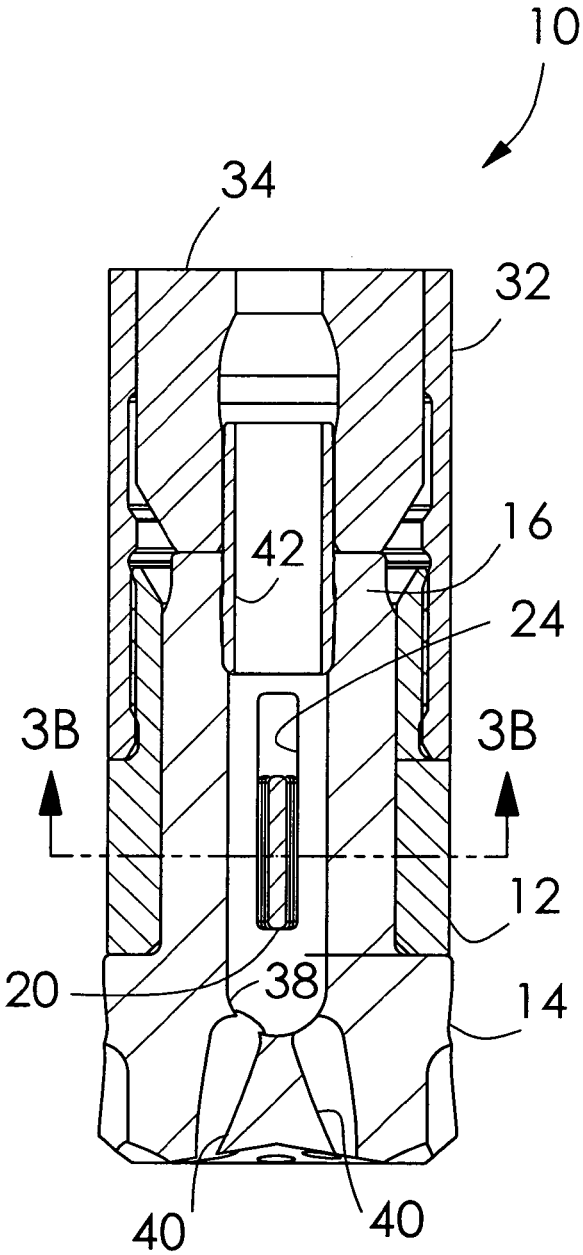
FIG. 3A is a sectioned view in elevation similar to FIG. 2A, except showing an alternative embodiment in which the key extends only through a large diameter portion of the keyed sub.
Figure 3B:
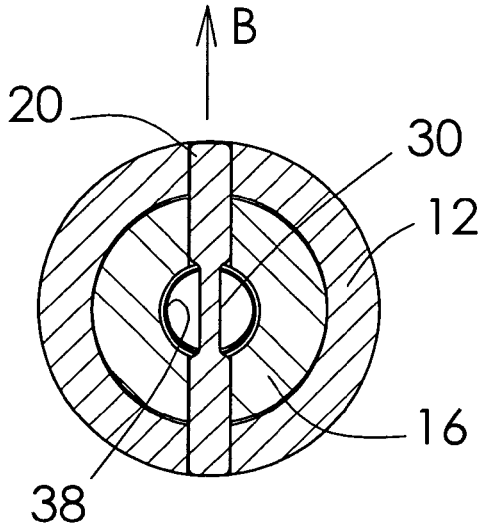
FIG. 3B is a cross-sectional plan view taken at the line 3B-3B in FIG. 3A.

FIGS. 3A and 3B show an alternative embodiment similar to FIGS. 1 and 2A-2C, except the key 20 in FIGS. 3A and 3B is configured to extend only through the portion of the keyed sub 12 having the full outer diameter D. Therefore, both the proximal and distal edges of the key 20 extend the full width W. Also, because the key 20 is not retained in place by the sleeve 32, the key 20 can be removed without disconnecting the sleeve 32 from the keyed sub 12. The key 20 is shown in the assembled position in FIG. 3B, i.e., extending through the opening 28*a*, through the slot 24 and through the opening 28*b*, with its ends equally spaced from the surrounding outer surface of the keyed sub 12. To help retain the key 20 in the assembled position, it may be configured with a tight fit, a snap ring or a positive engagement feature, such as, e.g., a detent requiring a positive force to be exceeded to move it in a removal direction B.

Figure 4A:
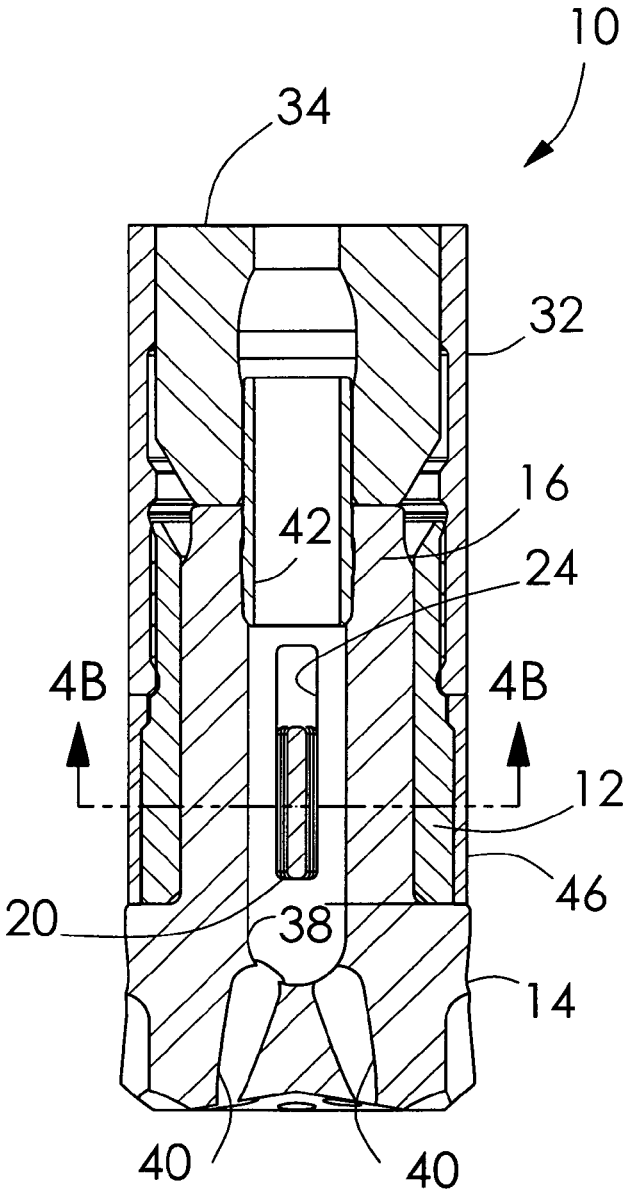
FIG. 4A is a sectioned view in elevation similar to FIG. 3A, except showing an alternative embodiment having a second wear sleeve surrounding the keyed sub.
Figure 4B:
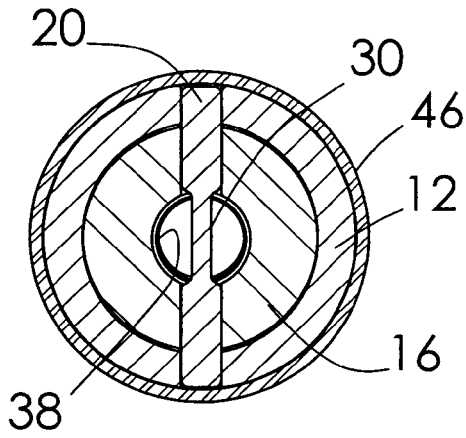
FIG. 4B is a cross-sectional plan view taken at the line 4B-4B in FIG. 4A.

FIGS. 4A and 4B show an alternative embodiment with a secondary wear sleeve 46 forming the outer surface in a region between the wear sleeve 32 and the bit 14. Thus, the secondary wear sleeve 46 surrounds the keyed sub 12 and covers the openings 22*a*, 22*b*. Thus, the key 20 is not accessible from the outer surface when the embodiment of FIGS. 4A and 4B is assembled. The use of a wear sleeve 46 extends the life of the keyed sub 12 in certain operating conditions.

Figure 5A:
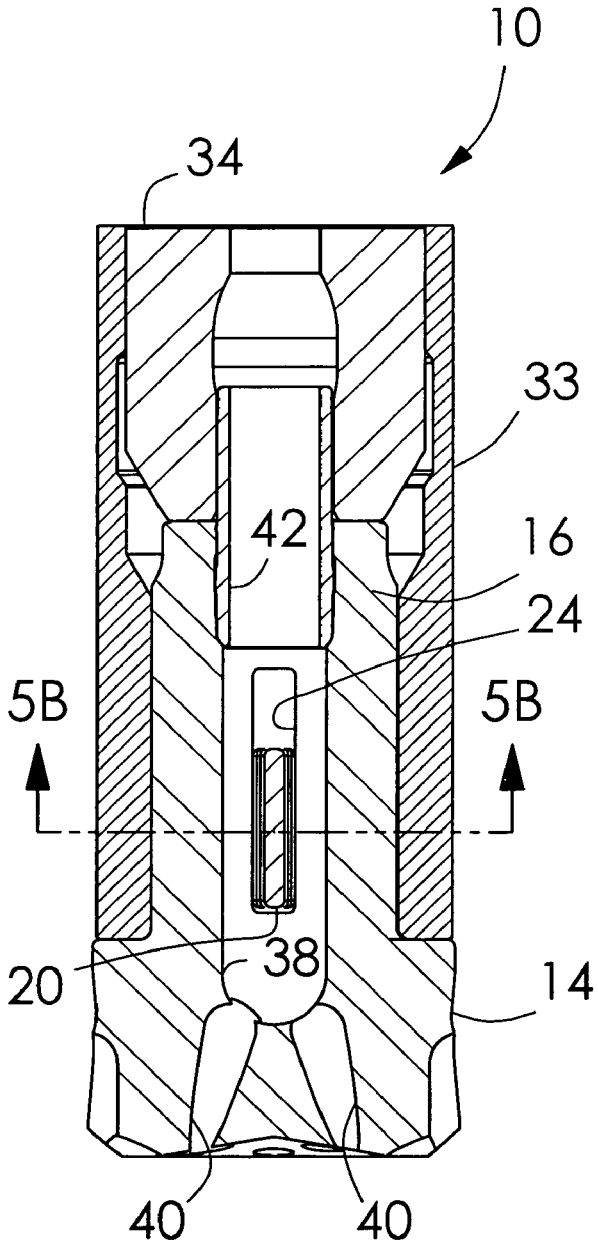
FIG. 5A is a sectioned view in elevation similar to FIG. 4A, except showing an alternative embodiment having a keyed sleeve replacing the keyed sub.
Figure 5B:
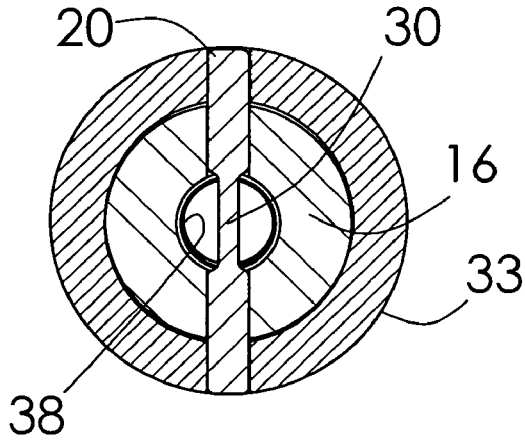
FIG. 5B is a cross-sectional plan view taken at line 5B-5B in FIG. 5A.

FIGS. 5A and 5B show an alternative embodiment having a keyed wear sleeve 33, which combines the functions of the sleeve 32 and the keyed sub 12 into a single component. Thus, the keyed sleeve 33 has the openings 28*a*, 28*b* and the bore 18 dimensioned to receive the shaft 16 of the bit 14. For certain operating conditions, the keyed sleeve 33 can be made of sufficiently strong material to resist excessive wear. Overall, the embodiment of FIGS. 5A and 5B requires fewer parts and thus is easier and cheaper to produce and maintain.

Figure 6A:
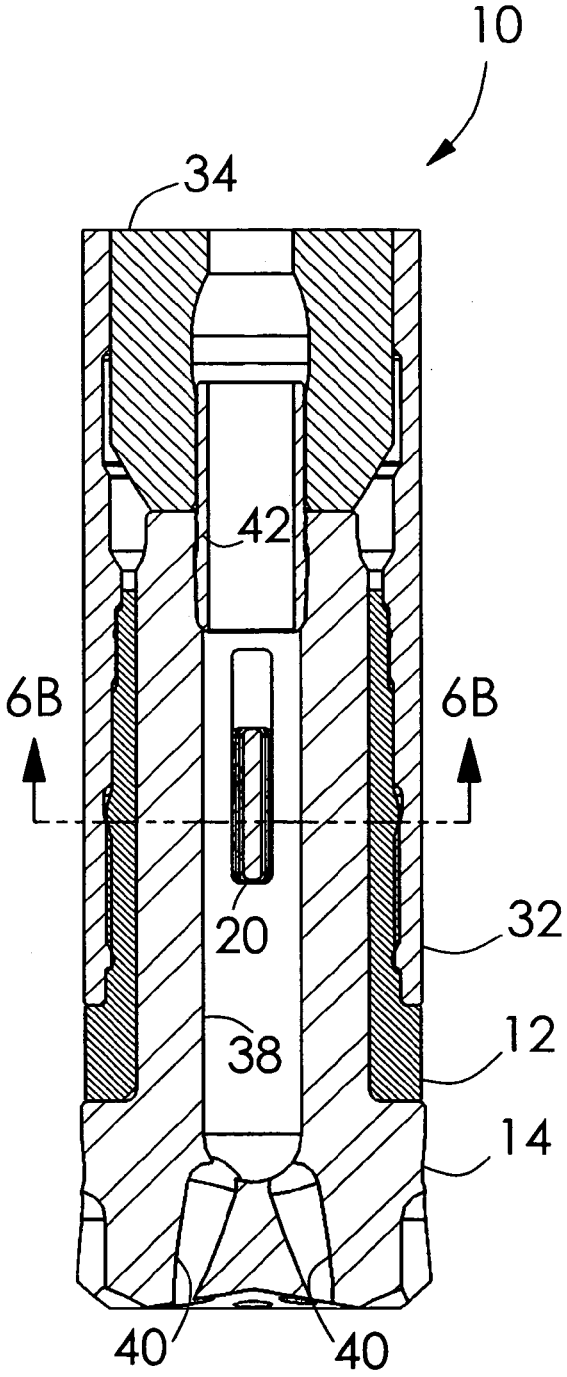
FIG. 6A is a sectioned view in elevation similar to FIG. 5A, except showing an alternative embodiment having a keyed sub configured for retrofitting in a sleeve of a conventional drilling tool.
Figure 6B:
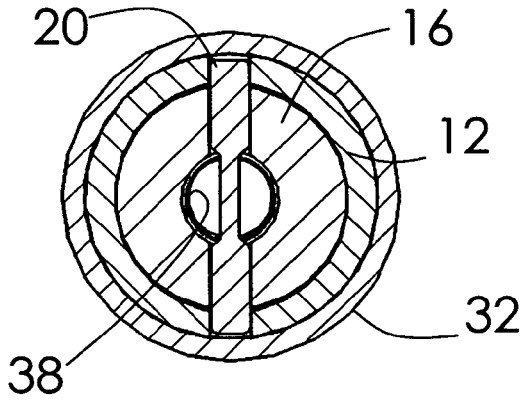
FIG. 6B is a cross-sectional plan view taken at the line 6B-6B in FIG. 6A.

FIGS. 6A and 6B show an alternative embodiment with a retrofit keyed top sub 12 having outer surface features configured to engage a conventional wear sleeve 32. To replace a bit and driver sub having conventional mounting features, e.g., a splined connection and/or retaining rings, the conventional driver sub is replaced by the keyed sub 12 shown in FIG. 6A. The bit 14 having the slot 24 is then secured to keyed sub 12 using the key 20 to replace the conventional bit. In this way, some of the efficiencies and convenience of the keyed connection approach can be achieved without requiring replacement of the sleeve 32 and possibly other associated components.

Figure 7A:
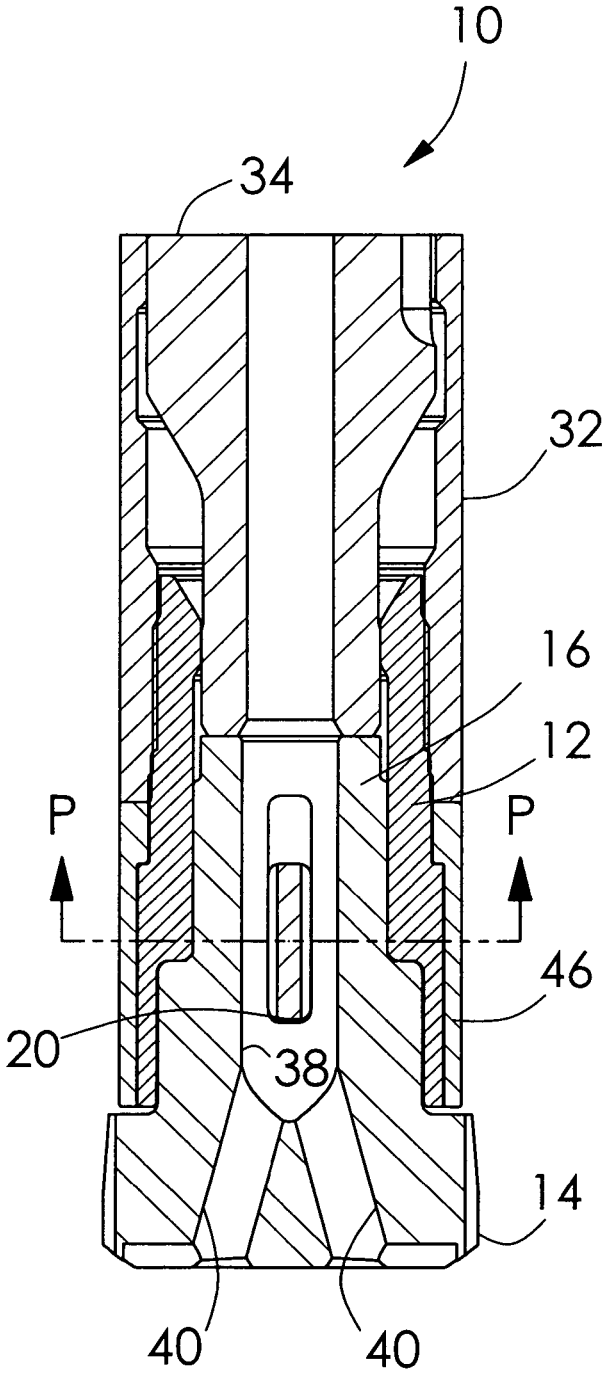
FIG. 7A is a sectioned view in elevation similar to FIG. 4A, except showing an alternative embodiment of the keyed sub for a reverse circulation drilling tools with an integrated lower air volume exhaust control and a surrounding wear sleeve.
Figure 7B:
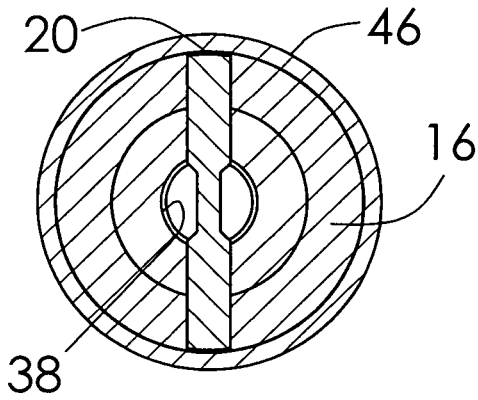
FIG. 7B is a cross-sectional plan view taken at the line 7B-7B in FIG. 7A.

FIGS. 7A and 7B show an alternative embodiment having the secondary wear sleeve 46 similar to the embodiment of FIGS. 4A and 4B, except for a drilling tool 10 without a blow tube 42 or foot valve.

Although the embodiments described above show drilling tools having an axial fluid passage, such as the bore 18, the keyed connection can also be implemented for other drilling tools in which there are no fluid passages or the fluid passages are positioned off-axis.

The keyed connection can be made of any suitable material. In embodiments where a threaded connection between the driver sub and the sleeve is eliminated, such as the embodiment of FIGS. 3A and B, these components can be made of a harder steel because they do not need to <<be>> gripped and rotated relative to each other to be tightened or loosened. Thus, these components can <<be>> made of a material, generally a steel, that even exceeds the hardness of the tools used to assemble/diassemble a conventional threaded driver sub connection, since tool slippage during attempts to rotate the components relative to each other is not a concern.

Figure 8A:
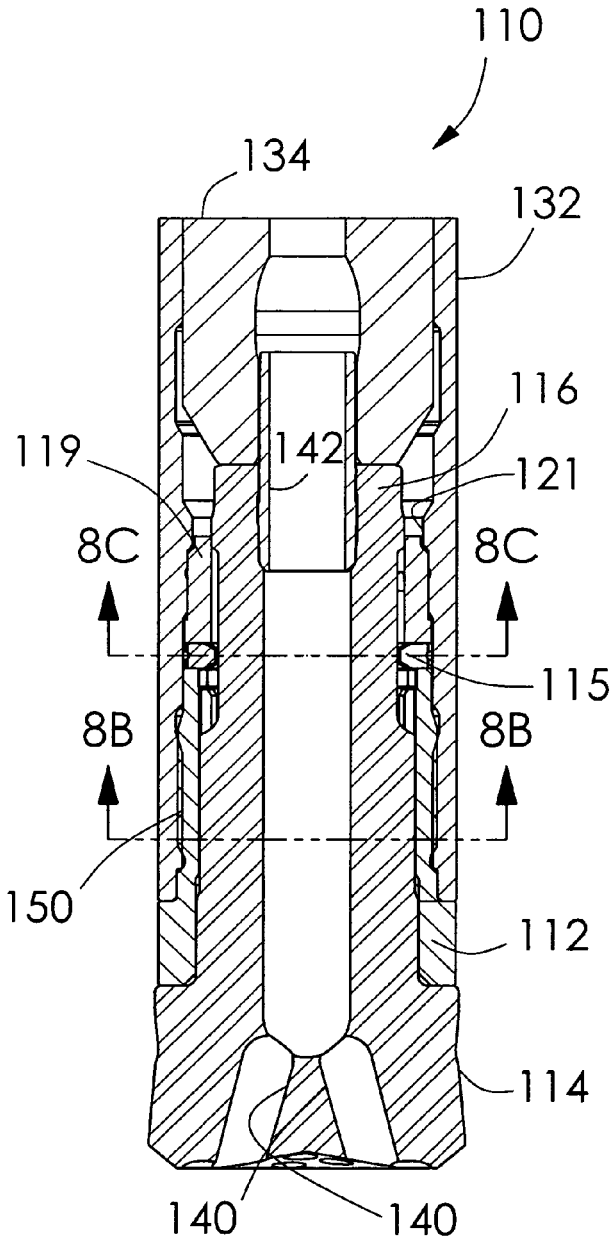
FIG. 8A PRIOR ART
FIG. 8A is a sectioned view in elevation of a conventional drilling tool portion showing a bit that is engaged with a driver sub by a splined connection and with an outer sleeve by bit retaining rings and a bit tube.
Figure 8C:
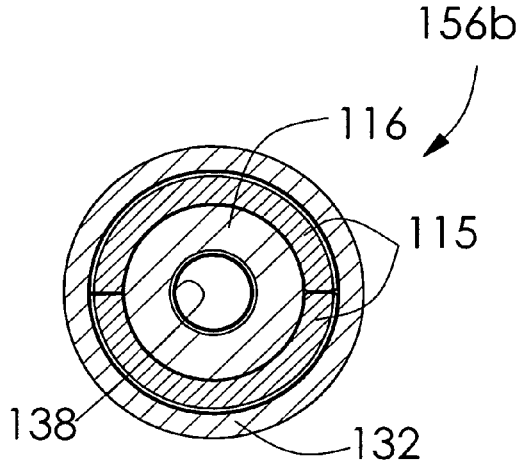
FIG. 8C PRIOR ART
FIGS. 8B and 8C are cross-sectional plan views taken at lines 8B-8B and 8C-8C, respectively, in FIG. 8A.
Figure 8B:
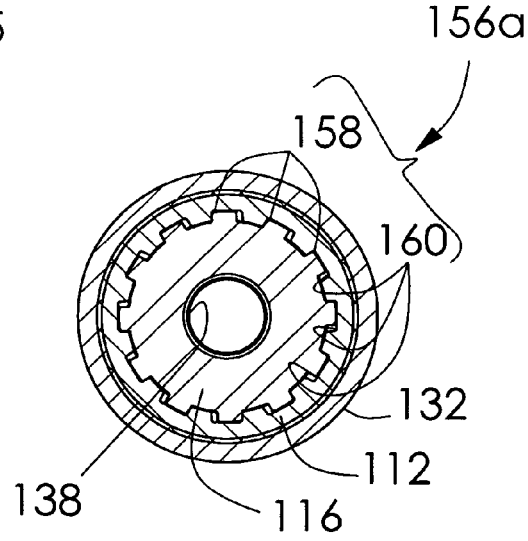
FIG. 8B PRIOR ART

For comparison with the new keyed connection, a corresponding portion of a conventional drilling tool 110 is shown in FIGS. 8A, 8B and 8C. In the conventional drilling tool 110, a bit 114 has a first connection to a driver sub 112 formed by a splined connection 156*a* of exterior splines 158 on the bit 114 and corresponding interior grooves 160 in the driver sub 112. The splined connection 156*a* functions to transmit torque to the bit 114. The driver sub 112 is connected to a proximal end of a surrounding wear sleeve 132 by a threaded connection 150. A reciprocable piston 134, axial passage 138 and blow tube 142 are also shown.

In the conventional drilling tool, the bit 114 has a second bit-retaining connection 156*b*. This second connection 156*b* secures the bit 114 within the drilling tool 110, such as to the wear sleeve 132. As shown in FIG. 8A, there are two retaining ring portions 115 together defining an inner periphery positioned to bear against a shoulder 117 on the shaft 116 of the bit 114, and an outer periphery positioned between a proximal end of the driver sub 112 and an annular bit guide 119. During operation, if the bit 114 encounters a void in the material being drilled, the second connection 156*b* functions to keep the bit 114 coupled to the drilling tool.

The splined connection 156*a* is difficult to manufacture and is subject to excessive wear in harsh environments. The conventional approach of using two separate connections for the bit, i.e., the splined connection 156*a* to transmit torque to the bit and the second bit-retaining connection 156*b*, consumes working length in the drilling tool, since each connection requires separate region, which makes the conventional drilling tool 110 less efficient than a comparable bit according to the present application. In some embodiments, bits according to the present application allow for a savings of up to about 50% in internal length consumed for connecting the bit to the remaining portion of the drilling tool, including the length required for connection(s), driving the bit and guiding the bit.

In addition, at least one component, i.e., the bit guide 119, can be eliminated. Also, there is no requirement to provide the separate guide surfaces 121 because the shaft 16 and bore 18 serve this function.

Moreover, a combined bit retaining approach such as described in connection with the above embodiments can eliminate the threaded connection between the driver sub 114 and the wear sleeve 132, which can become difficult to loosen and/or tighten after use. In addition, because the driver sub 114 and wear sleeve 132 have generally circular cross-sections, they must be made of a material softer than that of the tools used to grasp them for tightening and loosening operations.

In view of the many possible embodiments to which the principles described above may be applied, it should be recognized that the illustrated embodiments are only preferred examples and should not be taken as limiting in scope. Rather, the scope is defined by the following claims. I therefore claim as my invention all that comes within the scope and spirit of these claims.

What is claimed is:

1. A portion of a drilling tool having a drill bit driven in a rotating motion and in an axial percussion motion, comprising:

a keyed connection between the drill bit and a driver sub having a bore within which the drill bit can be received, the keyed connection comprising a transverse member and a transverse opening in the drill bit and opposed openings in the driver sub dimensioned to receive the transverse member, wherein the keyed connection when assembled couples the drill bit to the driver sub during rotation and percussion and is configured to transmit drive torque from the driver sub to the drill bit to drive the drill bit in rotation during use, and wherein the keyed connection is configured to permit relative percussive motion between the drill bit and the driver sub.

2. The portion of a drilling tool of claim 1, wherein the transverse opening in the drill bit has an axial extent greater than a corresponding dimension of the transverse member, thereby allowing the bit to move axially within a selected range while coupled to the driver sub.

3. The portion of a drilling tool of claim 1, wherein the transverse member is accessible from an outer surface of the driver sub.

4. The portion of a drilling tool of claim 1, further comprising a wear sleeve having a distal end to which the driver sub is connected.

5. The portion of a drilling tool of claim 4, wherein the driver sub is connected to the wear sleeve by a threaded connection.

6. The portion of a drilling tool of claim 1, further comprising a wear sleeve at least partially surrounding the driver sub, and wherein ends of the transverse member are covered by the wear sleeve.

7. The portion of the drilling tool of claim 1, wherein the bit comprises an axial bore for conveying a stream comprising at least fluid and the transverse opening is an axial slot intersecting the axial bore, the transverse member comprising an intermediate portion of reduced cross-section to minimize disruption of the stream through the bore.

8. The portion of the drilling tool of claim 1, wherein the transverse member has a first axial end and a second axial end opposite the first axial end, and wherein the first axial end has a shorter dimension than the second axial end.

9. A portion of a drilling tool having a drill bit with an inner bore and inner passages communicating with the inner bore for conveying a stream comprising at least a fluid during drilling operations, the drilling tool comprising:

a component having a bore sized to receive the drill bit and a transverse opening extending through at least one side of the bore; and a key shaped to be inserted through the transverse opening within the bore and to extend through an opening in the drill bit and at least partially into the inner bore of the drill bit to secure the drill bit to the component, wherein a portion of the key to be positioned within the inner bore has a reduced size to minimize disruption of the stream through the bore, and wherein the key and the transverse opening are together configured to transmit a drive torque from the component to the drill bit and to permit an axially percussive motion by the drill bit relative to the component when in use.

10. The portion of a drilling tool of claim 9, wherein the opening in the drill bit is a slot having an axial length greater than a corresponding dimension of the key, thereby allowing the bit to move axially within a selected range while secured to the component.

11. The portion of a drilling tool of claim 9, wherein the component is a driver sub.

12. The portion of a drilling tool of claim 9, wherein the component is a wear sleeve.

13. The portion of a drilling tool of claim 9, wherein the component is configured for attachment to a distal end of a wear sleeve.

14. The portion of a drilling tool of claim 9, wherein the component comprises a distal end having an outer diameter and a proximal intermediate portion separated from the distal end by a shoulder, the intermediate portion having a reduced diameter less than the outer diameter, wherein the at least one transverse opening has a proximal portion extending through the intermediate portion and a distal portion extending through the distal end, and wherein the key has a proximal edge with notched corners such that side edges of the key are alignable with outer surfaces of the intermediate portion and of the distal end.

15. The portion of a drilling tool of claim 14, further comprising a wear sleeve adapted to connect to the component and to abut against the shoulder, and wherein the wear sleeve covers at least a portion of the side edges of the key when connected to the component.

16. A drill bit connection for connecting a drill bit to a drilling tool, comprising:

an opening defined in the drill bit and extending transverse to an axis of the drill bit, the opening having a first axial dimension and a second dimension in the circumferential direction generally perpendicular to the axial direction; and a generally elongate key shaped to be inserted through the opening in the drill bit and having opposite ends shaped to be fixed to surrounding structure for holding the drill bit, wherein the key has a key axial dimension less than the first axial dimension of the opening and a key circumferential dimension sized to closely fit the second dimension of the opening, wherein a fit between the opening in the drill bit and the key allows the drill bit to be axially reciprocated relative to the key and the surrounding structure and allows the key to transmit a drive torque for smoothly rotating the drill bit when in use.

17. The drill bit connection of claim 16, wherein the drill bit has an axial bore, and wherein the opening intersects the axial bore.

18. The drill bit connection of claim 17, wherein the key has an intermediate portion between its opposite ends, and wherein the intermediate portion has a reduced cross-section smaller than a cross-section of either of the opposite ends.

19. The drill bit connection of claim 16, wherein the opening is a slot extending through the drill bit.

20. The drill bit connection of claim 16, wherein the surrounding structure is a chuck that receives the drill bit and the ends of the key are shaped to be fixed to the chuck.

21. The drill bit connection of claim 16, wherein the surrounding structure is a driver sub.

22. The drill bit connection of claim 16, wherein the surrounding structure is a wear sleeve.

23. The drill bit connection of claim 16, wherein the opening in the drill bit is a slot having a generally rectangular cross-section.

* * * * *